US008784229B1

(12) United States Patent
McCullough

(10) Patent No.: US 8,784,229 B1
(45) Date of Patent: Jul. 22, 2014

(54) LOWER BODY GOLF TRAINING AID

(76) Inventor: R. Jake McCullough, Odessa, TX (US)

( * ) Notice: Subject to any disclaimer, the term of this patent is extended or adjusted under 35 U.S.C. 154(b) by 78 days.

(21) Appl. No.: 13/543,980

(22) Filed: Jul. 9, 2012

(51) Int. Cl.
*A63B 69/36* (2006.01)

(52) U.S. Cl.
USPC ..... 473/257; 473/266

(58) Field of Classification Search
USPC ..... 473/207, 208, 215, 218, 219, 227, 257, 473/258, 261, 266, 268, 270–275
See application file for complete search history.

(56) References Cited

U.S. PATENT DOCUMENTS

| | | | | |
|---|---|---|---|---|
| 3,623,733 | A | 11/1971 | Cavanaugh | |
| 4,718,668 | A * | 1/1988 | Schipske | 473/462 |
| 5,203,569 | A | 4/1993 | Rilling | |
| 5,288,074 | A | 2/1994 | Scheurer | |
| 5,634,858 | A * | 6/1997 | Bellagamba | 473/257 |
| 5,707,300 | A | 1/1998 | May et al. | |
| 5,830,079 | A | 11/1998 | Hudson | |
| 5,916,037 | A | 6/1999 | Hill | |
| 6,497,627 | B2 * | 12/2002 | Collins | 473/264 |
| 6,575,844 | B1 * | 6/2003 | Gray | 473/277 |
| 6,843,730 | B1 * | 1/2005 | Bellagamba | 473/216 |
| 7,591,734 | B2 | 9/2009 | Mazzone | |
| 7,666,106 | B1 | 2/2010 | Hebert | |
| 7,758,443 | B1 * | 7/2010 | Ford | 473/266 |
| 7,775,900 | B1 * | 8/2010 | Karpyak et al. | 473/272 |
| 7,922,598 | B1 * | 4/2011 | Karpyak et al. | 473/272 |
| 7,980,958 | B1 * | 7/2011 | Ford | 473/266 |

* cited by examiner

*Primary Examiner* — Nini Legesse
(74) *Attorney, Agent, or Firm* — Robert C. Montgomery; Montgomery Patent & Design

(57) ABSTRACT

A golf training apparatus which aids golfers in perfecting their swing and associated body movements comprises a cushion and posts mounted to a frame which restricts a golfer's movement while in a golf stance and during a golf swing in order to develop a proper golf swing technique. A set of bars help the user to feel the proper rotation of their hips during a swing while avoiding unwanted lateral movement. The apparatus also comprises adjustable rods which extend sideways and forwardly from the frame to help a golfer to practice their swing path by keeping the swing within the rods. A golf ball alignment bar is located at a middle location at the base of the frame to help the golfer to consistently place the ball in the proper position prior to the golf swing.

14 Claims, 6 Drawing Sheets

LOWER BODY GOLF TRAINING AID

RELATED APPLICATIONS

There are currently no applications co-pending with the present application.

FIELD OF THE INVENTION

The present invention relates generally to a training aid to assist golfers in perfecting their golf swings and, more particularly, to said training aid comprising a frame to teach proper stance orientation to guide proper hip rotation, to calibrate swing path, and to assist with consistent ball placement.

BACKGROUND OF THE INVENTION

One (1) of the basic skills required to succeed in the game of golf is the ability to keep one's body in the correct position throughout the entire swing. The torso and waist of many golfers moves about haphazardly during a swing. This movement then causes the rest of the body to compensate, thus resulting in haphazard swings that are inconsistent. Accordingly, there is a continual need for new and innovative golf training equipment that will help to improve a golfer's swinging technique. The development of the apparatus herein fulfills this need.

There have been several attempts in the past to invent training aids to improve a golfer's swing. U.S. Pat. No. 7,666,106 issued to Herbet discloses a posture correcting tool for golf swings that incorporates a series of bars to align the golfer's buttocks, hips, and head. This patent does not disclose any means to calibrate swing path or any means to assist with consistent ball placement.

U.S. Pat. No. 7,591,734 issued to Mazzone discloses a golf swing aid that uses one (1) or more "L"-shaped members to position and guide a golfer's hips in order to prevent lateral movement. This patent does not disclose any means to calibrate swing path or any means to assist with consistent ball placement.

U.S. Pat. No. 6,843,730 issued to Bellagamba discloses a golf training apparatus that assists with positioning a golfer's head, back, and knees. This patent does not disclose any means to calibrate swing path or any means to assist with consistent ball placement.

U.S. Pat. No. 6,575,844 issued to Gray discloses a golf stance and movement training device that assists with positioning a golfer's back and knees in order to promote balance on the balls of the golfer's feet. This patent does not disclose any means to calibrate swing path or any means to assist with consistent ball placement.

U.S. Pat. No. 5,916,037 issued to Hill discloses a golf training device and method that applies pressure to a golfer's hip and includes a base for receiving a golfer's foot. This patent does not disclose any back support, any means to calibrate swing path, or any means to assist with consistent ball placement.

U.S. Pat. No. 5,830,079 issued to Hudson discloses a stance and movement swing training apparatus for golf and other sports that assist in positioning a golfer's buttocks, hips, and knee. This patent does not disclose any means to calibrate swing path or any means to assist with consistent ball placement.

U.S. Pat. No. 5,707,300 issued to May discloses a golf swing training apparatus that utilizes a series of rods to position a golfer's knees and hips. This patent does not disclose any back support, any means to calibrate swing path, or any means to assist with consistent ball placement.

U.S. Pat. No. 5,634,858 issued to Bellagamba discloses a golf training apparatus that aids in positioning a golfer's head, knees, and feet and further provides a series of mirrors to allow a golfer to examine their stance. This patent does not disclose any back support, any means to calibrate swing path, or any means to assist with consistent ball placement.

U.S. Pat. No. 5,288,074 issued to Scheurer discloses a golfer's hip turn restrictor training aid that incorporates a hook-shaped device to position a golfer's hip. This patent does not disclose any back support, any means to calibrate swing path, or any means to assist with consistent ball placement.

U.S. Pat. No. 5,203,569 issued to Rilling discloses a golf stance trainer that monitors the position of a golfer's buttocks, hips, and knees and alerts the golfer when their stance is incorrect. This patent does not disclose any means to calibrate swing path or any means to assist with consistent ball placement.

U.S. Pat. No. 3,623,733 issued to Cavanaugh discloses a posture correcting tool for golf swings by utilizing a body cage member to guide a golfer's hips and a hitting track for proper ball placement. This patent does not disclose any back support or any means to calibrate swing path.

While these devices fulfill their respective, particular objectives, each of these references suffers from one (1) or more of the aforementioned disadvantages. Accordingly, there is a need for a means by which an apparatus can aid a golfer in learning proper lower body movement that avoids early extension of the back or lateral movement in the hips while also assisting the golfer with learning proper swing paths and consistent ball placement. The development of the present invention substantially departs from the conventional solutions and in doing so fulfills this need.

SUMMARY OF THE INVENTION

In view of the foregoing disadvantages inherent in the prior art, it has been observed that there is need of a training aid to assist golfers in perfecting their golf swing and associated body movements.

To achieve the above objectives, it is an object of the present invention to provide a golf training apparatus to assist golfer's in perfecting their golf swings by teaching proper back orientation, hip rotation, swing path, and consistent ball placement.

A further object of the present invention is to provide an apparatus comprising a hurdle-shaped frame portion further comprising a top-mounted back cushion, opposing "T"-shaped foot portions, and a plurality of protruding post portions.

Another object of the present invention is where the apparatus is made of a strong composite plastic such as PVC.

Yet another object of the present invention is where the hurdle-shaped frame is comprised of two (2) independent and connecting pieces that allow the apparatus to be adjustable in height.

Yet still another object of the present invention is where the top-mounted back cushion is vertically adjustable to align with a golfer's waist area providing a correct front-to-back stance for the golfer.

Yet still another object of the present invention is providing a plurality of the protruding post portions to comprise a hip post assembly to provide physical contact with the golfer's hips to indicate proper or improper hip movement during both backswing and follow-through portions of a golf swing.

Yet still another object of the present invention is providing a plurality of the protruding post portions to comprise a restrictor post assembly extending horizontally in both directions from the apparatus to force the golfer to maintain a straight swing during both the backswing and the follow through portions of the swing to avoid contact with the restrictor post assembly.

Yet still another object of the present invention is providing a plurality of the protruding post portions to comprise a second restrictor post assembly designed to restrict the golfer's swing when practicing the golfer's "short game."

Yet still another object of the present invention is providing opposing "T"-shaped foot portions that extend perpendicularly from the base of the hurdle-shaped frame and further comprise a plurality of caps to provide a stable foundation for the apparatus.

Yet still another object of the present invention is providing a golf ball alignment assembly to comprise a rod-shaped ball alignment pointer and a tubular ball alignment sleeve which assists the golfer in developing consistent golf ball placement.

Yet still another object of the present invention is to provide a method of utilizing the apparatus may be achieved by performing the following steps: assembling the upper frame to the lower frame; adjusting a relative height of the upper frame, thereby positioning the back cushion so as to contact a golfer's waist area; securing the upper frame in position; utilizing one (1) or both hip post assemblies by pivoting said hip post assemblies upward to a horizontal orientation; laterally positioning said hip post assemblies on either side of said back cushion until obtaining a desired distance from a hip portion of the golfer's body; securing said hip post assemblies to said upper frame; utilizing the ball alignment assembly by pivoting said ball alignment assembly downward in a forward direction until at a horizontal orientation; adjusting said ball alignment assembly from side-to-side so as to indicate a desired position of the golf ball; utilizing the first restrictor posts, if desired, by slidingly extending one (1) or both first restrictor posts outwardly a desired distance; and, utilizing the post features of the apparatus to provide contact-type feedback to a golfer while executing practice golf swings.

Yet still another object of the present invention is to provide a method of utilizing the one or both of the second restrictor post assemblies to improve a "chip-shot" swing may be achieved by performing the following steps: disassembling the upper frame from the lower frame; mounting one (1) or both of the second restrictor post assemblies onto the upper frame; positioning each second restrictor post assemblies at a desired height; securing said second restrictor post assemblies; and, utilizing the apparatus to practice a short-game golf swing using iron-type golf clubs.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
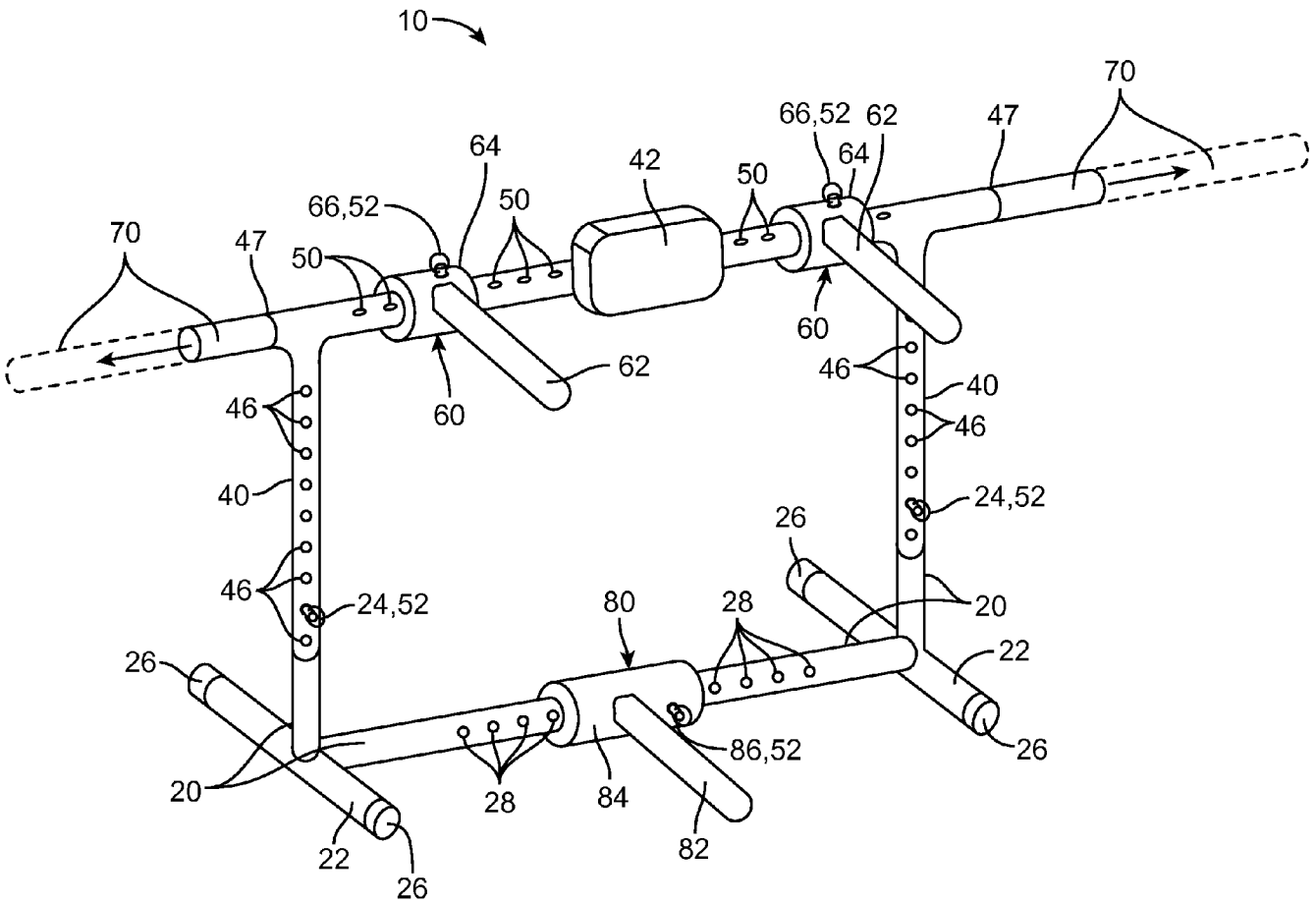
FIG. 1 is a perspective view of the lower body golf training aid 10 depicting a deployed state, according to a preferred embodiment of the present invention.

10 lower body golf training aid
20 lower frame
22 foot
24 first lower frame aperture
26 cap
28 second lower frame aperture
40 upper frame
42 back cushion
44 bracket
46 first upper frame aperture
47 post aperture
50 second upper frame aperture
52 locking pin
54 first restrictor post aperture
60 hip post assembly
62 hip post
64 hip post sleeve
66 hip post aperture
70 first restrictor post
80 ball alignment assembly
82 ball alignment pointer
84 ball alignment sleeve
86 ball alignment aperture
90 second restrictor post assembly
92 second restrictor post
94 second restrictor sleeve
96 second restrictor aperture
100 golfer
102 left foot
104 right foot
106 golf club
108 golf ball

DETAILED DESCRIPTION OF THE PREFERRED EMBODIMENT

The best mode for carrying out the invention is presented in terms of its preferred embodiment, herein depicted within FIGS. 1 through 6, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a lower body golf training aid (herein described as the "apparatus") 10, which provides a means to help golfers 100 perfect various golf swings by controlling associated body movements. The apparatus 10 comprises a hurdle-shaped frame portion 20, 40 further comprising a top-mounted back cushion 42 and opposing "T"-shaped foot portions 22. The apparatus 10 comprises a plurality of protruding post portions 60, 70, 80, 90 which provide feedback to the golfer 100 during a practice swing as to positioning of body portions as well as a swing path of the golf club 106.

Figure 2:
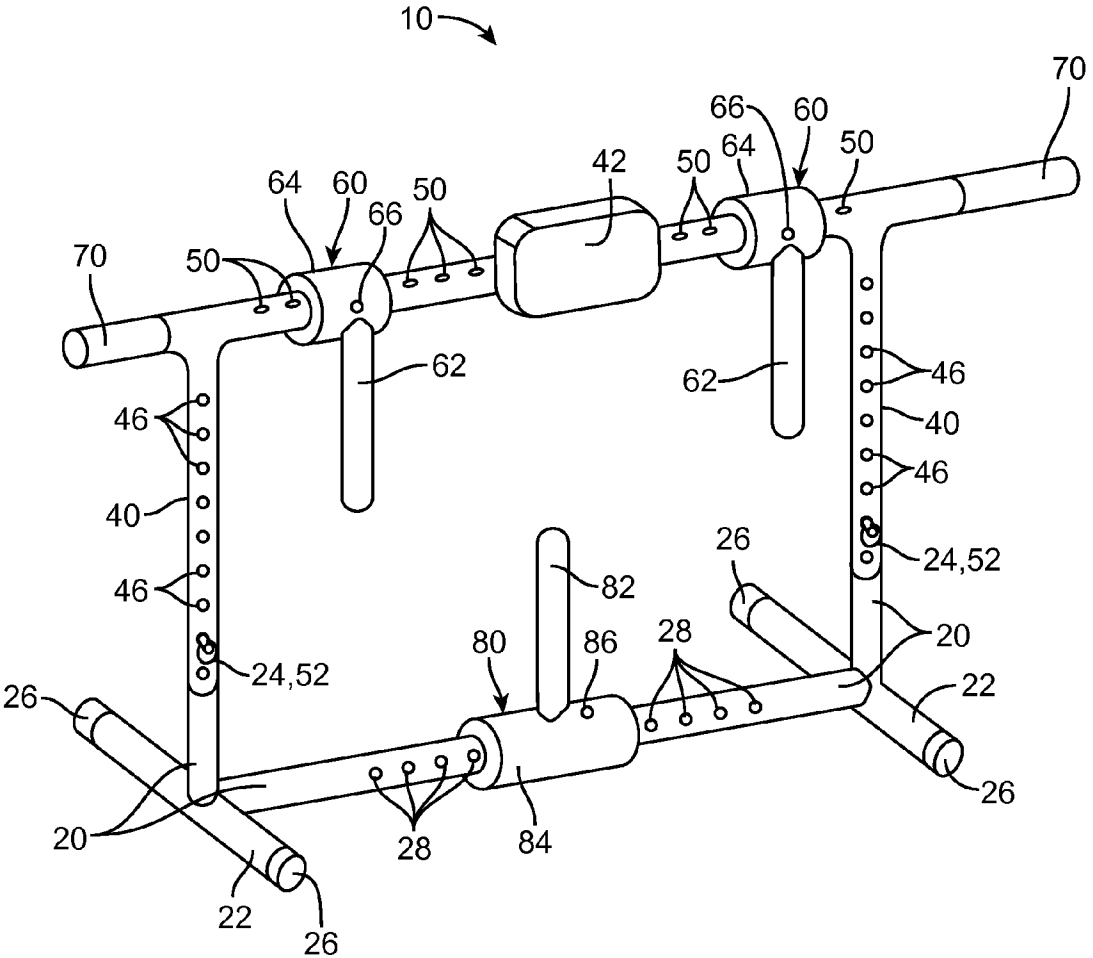
FIG. 2 is a perspective view of the lower body golf training aid 10 depicting a stowed state, according to a preferred embodiment of the present invention.

Referring now to FIGS. 1 and 2, perspective views of the apparatus 10 depicting deployed and stowed states, according to a preferred embodiment of the present invention, are disclosed. The apparatus 10 comprises a two-piece hurdle-shaped hollow tubular frame envisioned to be made using a strong composite plastic such as PVC or a light-weight metal material such as aluminum. The frame further comprises lower frame 20 and an upper frame 40 portions having respective pairs of joined parallel vertical leg members. Said joined leg portions of the lower 20 and upper 40 frames are to be telescopingly joined together and subsequently affixed at a desired relative position via a plurality of equally-spaced first upper frame apertures 46 arranged along front and rear surfaces of the upper frame 40, a respective first lower frame aperture 24 through the lower frame 20, and respective insertable locking pins 52, thereby providing a height adjustable means to the upper frame portion 40 as well as an attachment means to a pair of second restrictor posts 90 (see FIG. 6).

Figure 4:
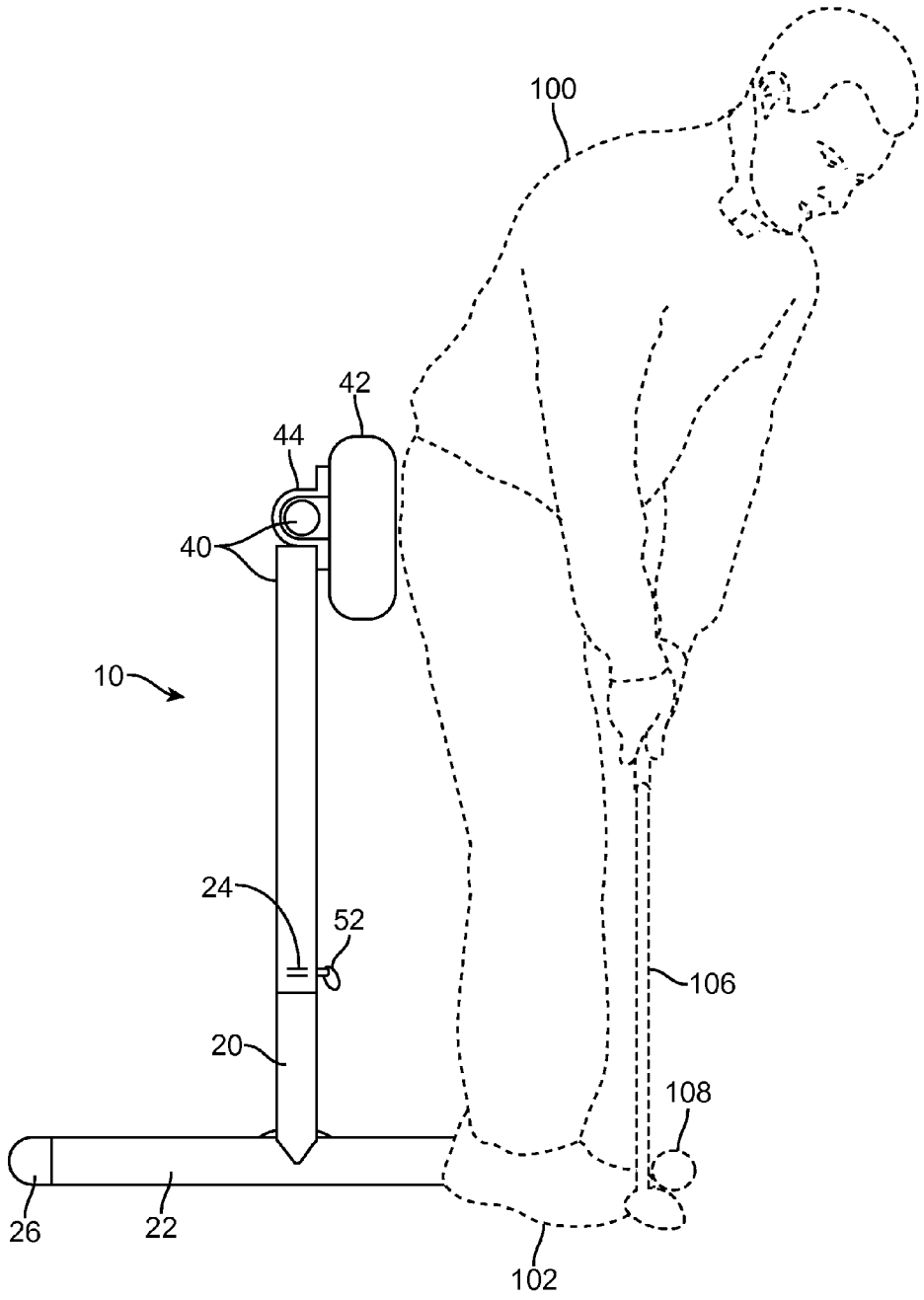
FIG. 4 is a sectional side view of the lower body golf training aid 10 depicting an in-use state taken along section line A-A (see FIG. 3), according to a preferred embodiment of the present invention.

The upper frame 40 comprises an inverted "U"-shaped structure further comprising an integral upper horizontal member with an intermediately mounted cushion 42 and a pair of laterally-adjustable hip post assemblies 60 positioned on each side of said back cushion 42 (see FIG. 4). The upper frame 40 and back cushion 42 may be adjusted vertically in a coincidental manner via the previously described first upper frame apertures 46 so as to be aligned with a golfer's 100 waist or gluteus-maximus areas, thereby providing a correct front-to-back stance for the golfer 100. Each hip post assembly 60 comprises a unitary plastic molding or metal weldment further comprising a hollow cylindrical-shaped hip post sleeve 64 and an integral rod-shaped hip post 62 which protrudes perpendicularly outward from said hip post sleeve 64. Said hip post 62 is envisioned to extend horizontally forward approximately six (6) to twelve (12) inches. Said hip post sleeve 64 provides lateral sliding attachment and securement means to said upper frame 40. In use, the hip post assemblies 60 are positioned laterally at a desired distance from a golfer's 100 waist or hip areas with the hip posts 62 extending forwardly and horizontally. Said hip post assemblies 60 are then secured to the upper frame 40 via insertion of respective locking pins 52 through a hip post aperture portion 66 of each hip post assembly 60 and through one (1) of a plurality of equally-spaced second upper frame apertures 50 being positioned along side surfaces of a horizontal portion of said upper frame 40. Said locking pins 52 are envisioned to comprise commercially-available quick-disconnect devices such as detent ring pins, wire lock pins, or the like, enabling easy installation and removal without using tools. The proper positioning of said hip post assemblies 60 is to provide physical contact feedback to the golfer 100 during a practice swing, thereby indicating proper or improper hip movement during both backswing and follow-through portions of a golf swing.

The upper frame 40 further comprises a pair of first restrictor post apertures 47 located at upper opposing end portions. Said first restrictor post apertures 47 provide horizontal open end portions allowing snug insertion of respective first restrictor posts 70. The first restrictor posts 70 comprise tubular or solid round members which provide an adjustable linear extension of the horizontal portion of the upper frame 40 in both directions, thereby acting to force a golfer 100 to maintain a straight golf swing during both the backswing and follow-through portions to avoid contact with said first restrictor posts 70.

The previously described first upper frame apertures 46 also provide selective attachment of a pair of second restrictor post assemblies 90. Said second restrictor post assemblies 90 provide a similar golf swing feedback function as the first restrictor post apertures 47; however, said second restrictor post assemblies 90 are designed to restrict a length of travel of a golf swing when using an iron-type golf club 106 to improve a golfer's 100 short game (see FIG. 6).

The lower frame 20 comprises a unitary "U"-shaped structure having a pair of horizontal "T"-shaped foot portions 20 which extend perpendicularly outward from bottom side portions of said lower frame 20 to provide a stable foundation to the apparatus 10 upon a floor surface. Said feet 22 further comprise protective plastic or rubber caps 26 affixed to end portions of said feet 22 via a press-fit.

An integral bottom horizontal member of the "U"-shaped lower frame 20 spans a distance between said feet 22 and provides an attachment means to a golf ball alignment assembly 80. Said golf ball alignment assembly 80 provides a means to laterally position a golf ball 108 in an accurate and repeatable manner (also see FIGS. 3, 4, and 5). Said ball alignment assembly 80 comprises a unitary molded or welded structure further comprising a rod-shaped ball alignment pointer 82 and a tubular ball alignment sleeve 84 which provides lateral sliding attachment to the lower frame 20. In use, said ball alignment assembly 80 is positioned laterally at a desired position along the lower frame 20 to position the ball alignment pointer 82 between left foot 102 and right foot 104 portions of the golfer 100. Said ball alignment assembly 80 is secured to said lower frame 20 via insertion of a locking pin 52 through a ball alignment aperture portion 86 of the ball alignment sleeve 84 and one (1) of a plurality of equally-spaced second lower frame apertures 28 being positioned along side surfaces of said lower frame 20.

The hip post assemblies 60 and ball alignment assemblies 80 may be positioned in a vertical or stowed orientation, as seen in FIG. 2, when not required for a particular practice session, or to enable more compact storage of the apparatus 10 when not being used.

Figure 3:
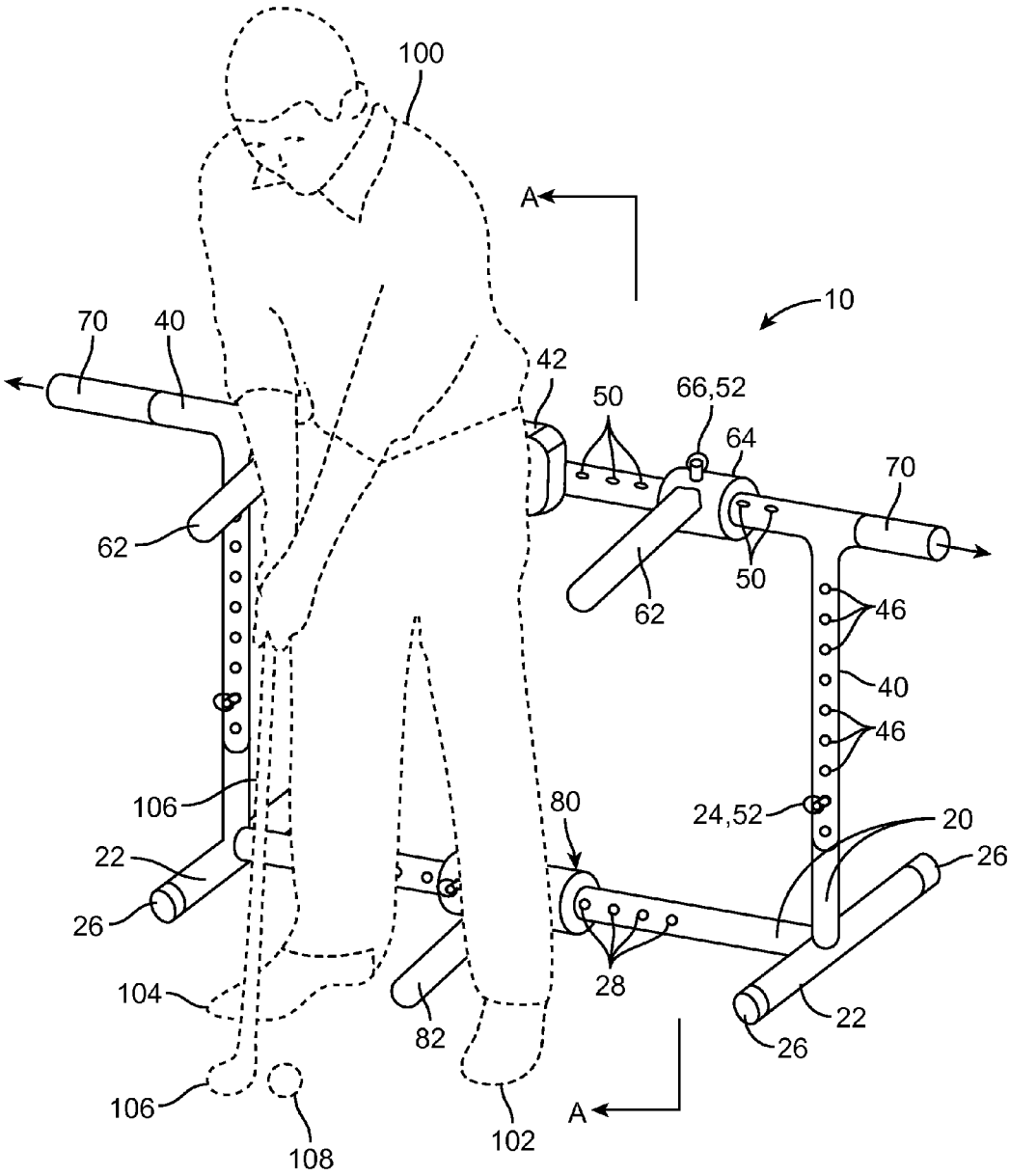
FIG. 3 is a perspective environmental view of the lower body golf training aid 10 depicting an in-use state, according to a preferred embodiment of the present invention.
Figure 5:
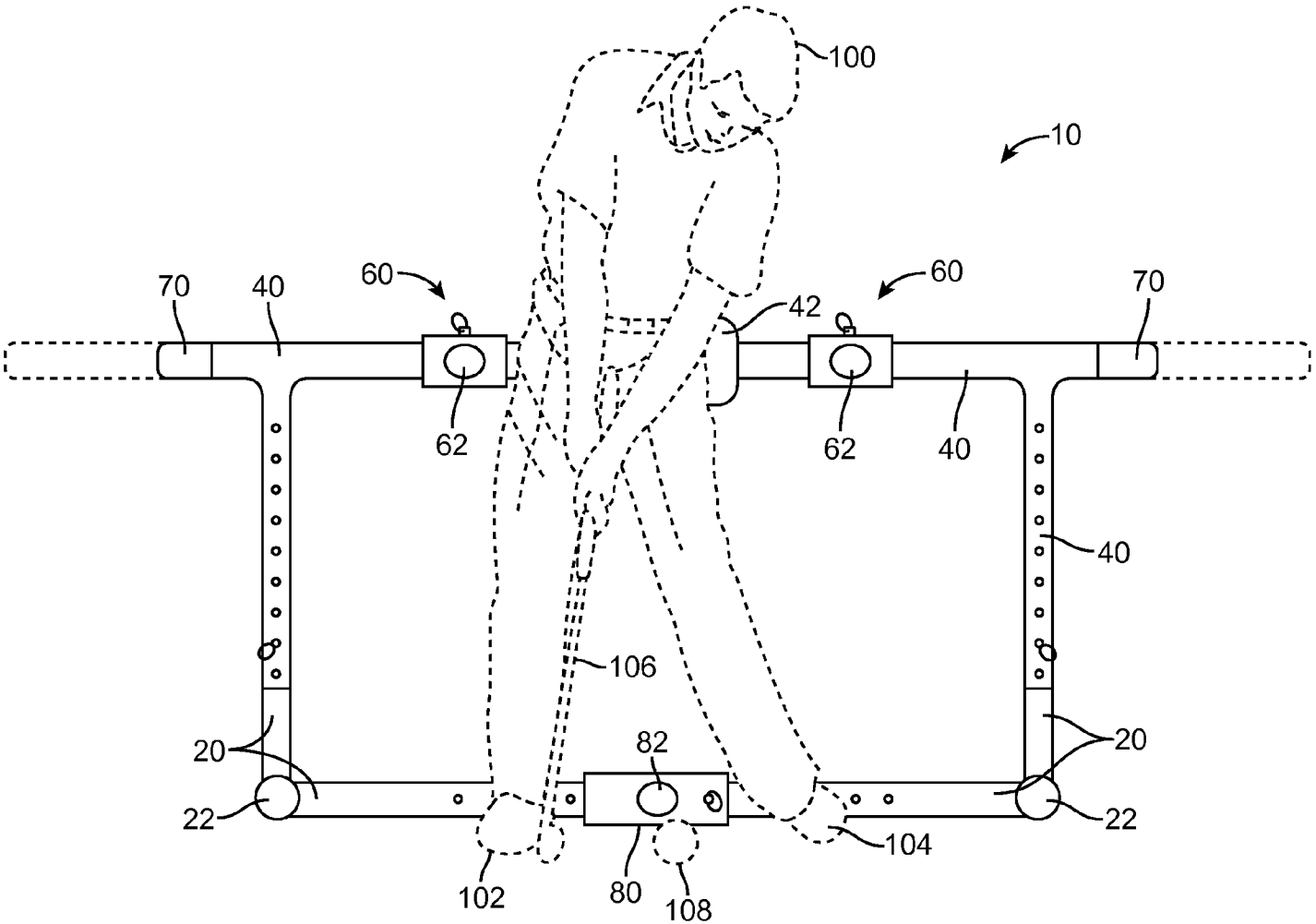
FIG. 5 is a front view of the lower body golf training aid 10, according to a preferred embodiment of the present invention; and, FIG. 6 is a perspective view of the lower body golf training aid 10 depicting attachment of a pair of second restrictor post assemblies 90, according to an alternate embodiment of the present invention.

Referring now to FIGS. 3, 4, and 5, perspective, side, and front environmental views of the apparatus 10 depicting in-use states, according to a preferred embodiment of the present invention, are disclosed. In use, the golfer 100 would make contact with the back cushion 42 while in the golf stance. A proper stance and swing will result in uninterrupted contact between the body of the golfer 100 and the back cushion 42. Said back cushion 42 comprises a vinyl-covered foam-padded construction being stationarily affixed along a rear surface to the horizontal portion of the upper frame 40 via at least one (1) "U"-shaped bracket 44 as seen in FIG. 4. The laterally-adjustable hip post assemblies 60 are then positioned at a desired distance from respective hip areas of the golfer 100. The hip post assemblies 60 would help the golfer 100 to feel the proper rotation of their hips and avoid excessive lateral movement of hip portions to either side during the golf swing. It is understood that a golfer 100 may utilize either or both hip post assemblies 60 or just the back cushion 42 as desired. In like manner the ball alignment pointer 62 may be adjusted from side-to-side via the ball alignment assembly 80 to aid a golfer 100 while properly and accurately positioning a golf ball 108. Finally, one (1) or both of the first restrictor posts 70 may be extended horizontally outward to permit a golfer 100 to work on their swing path by helping to keep their swing in front of said restrictor posts 70 while performing a slow motion practice swing.

Figure 6:
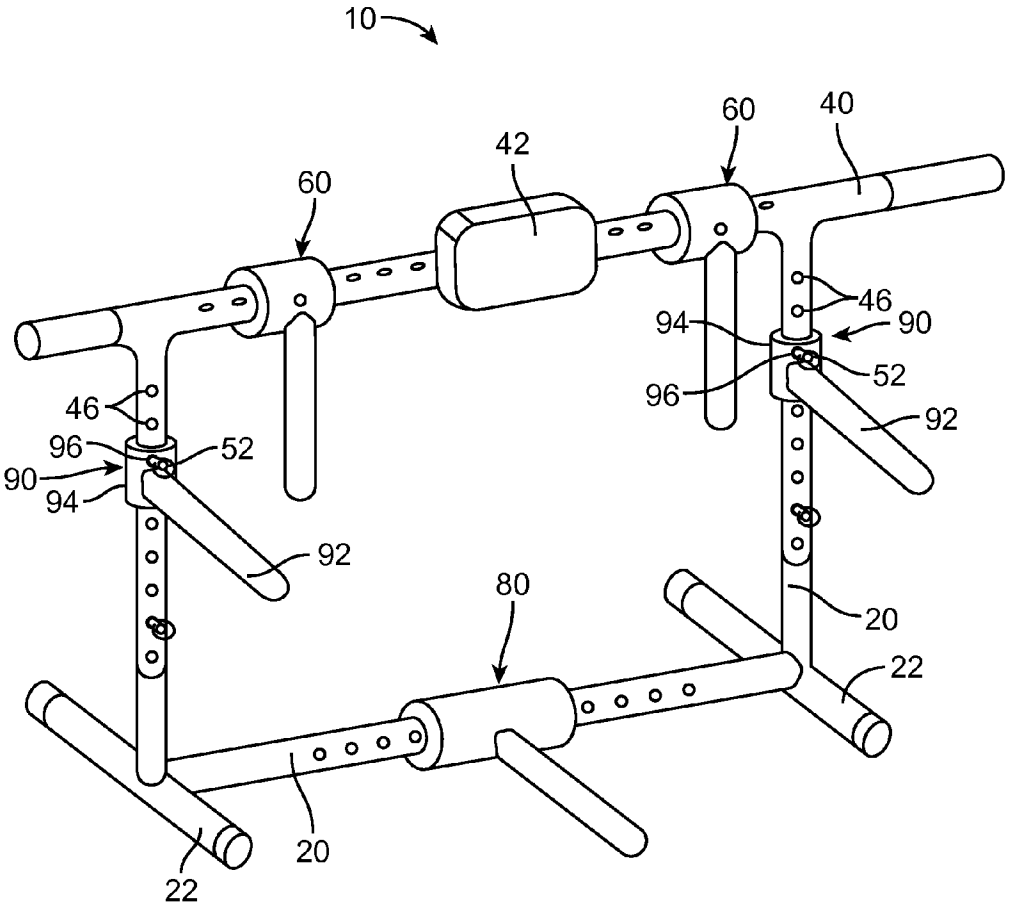

Referring now to FIG. 6, a perspective view of the apparatus 10 depicting attachment of a pair of second restrictor post assemblies 90, according to an alternate embodiment of the present invention, is disclosed. The apparatus 10 provides a means to control a golf swing while practicing a "chipping game" using iron-type golf clubs 106 via attachment of one (1) or both second restrictor post assemblies 90 to upper vertical portions of the upper frame 40. The second restrictor post assemblies 90 are similar in construction and attachment method as the previously described hip post assemblies 60. Each second restrictor post assembly 90 further comprises a second restrictor post 92, a second restrictor sleeve 94, and a second restrictor aperture 96 which allow selective attachment to the upper frame 40 at various heights using the first upper frame apertures 46 and the locking pin 52. Said second restrictor post assemblies 90 are to be selectively positioned along said upper frame 40 at a desired height so as to extend forwardly and provide a contact means with a golf club 106 upon exceeding an acceptable amount of backswing or follow-through during a practice swing.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 through 6.

The method of installing and utilizing the apparatus 10 may be achieved by performing the following steps: assembling the upper frame 40 to the lower frame 20 by inserting the vertical tubular portions of said lower frame 20 into the vertical tubular portions of said upper frame 40; adjusting a relative height of the upper frame 40, thereby positioning the back cushion 42 so as to contact a golfer's 100 waist or gluteus-maximus area; securing the upper frame 40 in position by inserting a locking pin 52 through a first upper frame aperture 46 and a first lower frame aperture 24 of the upper 40 and lower 20 frame portions, respectively; utilizing one (1) or both hip post assemblies 60 by pivoting said hip post assemblies 60 upward to a horizontal orientation; laterally positioning said hip post assemblies 60 on either side of said back cushion 42 until obtaining a desired distance from a hip portion of the golfer's body 100; securing said hip post assemblies 60 to said upper frame 40 by inserting a locking pin 52 through respective hip post apertures 66 and second upper frame apertures 50; utilizing the ball alignment assembly 80 by pivoting said ball alignment assembly downward in a forward direction until at a horizontal orientation; adjusting said ball alignment assembly 80 from side-to-side so as to indicate a desired position of the golf ball 108; utilizing the first restrictor posts 70, if desired, by slidingly extending one (1) or both first restrictor posts 70 outwardly a desired distance; and, utilizing the post features 60, 70, 80 of the apparatus 10 to provide contact-type feedback to a golfer 100 while executing practice golf swings.

The method of installing and utilizing one (1) or both of the second restrictor post assemblies 90 to improve a "chip-shot" swing may be achieved by performing the following steps: disassembling the upper frame 40 from the lower frame 20, if previously assembled; mounting one (1) or both of the second restrictor post assemblies 90 onto the upper frame 40 by slidingly installing respective second restrictor sleeves portions 94 upon vertical portions of the upper frame 40; positioning each second restrictor post assemblies 90 at a desired height; securing said second restrictor post assemblies 90 by inserting a locking pin 52 through a second restrictor aperture portion 96 and an aligned first upper frame aperture 46; and, utilizing the apparatus 10 to practice a short-game golf swing using iron-type golf clubs 106.

It is envisioned that the hip post assemblies 60 would help the golfer 100 to feel the proper rotation of their hips and avoid excessive lateral movement of said hip portions to either side. It is also understood that a golfer 100 may utilize either or both hip post assemblies 60 or utilize just the back cushion 42, if desired, to provide a customized practice session. In like manner the ball alignment assembly 80 may be adjusted from side-to-side to aid a golfer 100 to properly and accurately position successive golf balls 108. If desired, one (1) or both of the first restrictor posts 70 may be extended horizontally outward to permit a golfer 100 to work on their swing path by helping to keep their swing in front of said restrictor posts 70 during a slow motion practice swing. Finally, one (1) or both second restrictor posts 90 may be mounted and utilized to improve a short game golf swing while using iron-type golf clubs 106 to provide feedback during a golf swing if the golfer 100 exceeds an acceptable amount of backswing or follow-through during a "chip-shot" practice swing.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A golf training aid, comprising:

a frame portion, comprising a lower frame member removably inserted into an upper frame member, said lower frame member having spaced apart apertures, a first foot at one end and a second foot at another end;

a back cushion selectively and removably positioned on said upper frame member;

a pair of hip posts each selectively positioned on said upper frame member; and, a ball positioning assembly on said lower frame member, said ball positioning assembly having a ball alignment sleeve with a ball alignment aperture slideably located on said lower frame member, a ball positioning pointer and a ball alignment pin;

wherein said upper frame member is adjustable relative to said lower frame member;

wherein said ball positioning assembly can be locked in place on said lower frame member by said ball alignment pin passing through said ball alignment aperture and an aperture in said lower frame member.

2. The training aid of claim 1, wherein said upper frame comprises:

a "U"-shaped frame body comprising:

an upper horizontal frame member; and, a pair of upper frame posts parallel to each other and depending downward from said upper horizontal frame member;

said lower frame member further comprises:

a pair of lower frame posts extending up from said first foot and from said second foot;

wherein each of said lower frame posts are removably inserted into each of said upper frame posts; and, wherein said upper frame member is selectively adjustable to a desired position by mating a desired one of a plurality of upper frame post apertures on each of said upper frame posts with a lower frame post aperture on each of said lower frame posts and inserting a locking pin therethrough.

3. The training aid of claim 2, further comprising a pair of restrictor posts each removably inserted into a restrictor post aperture on opposing ends of said upper horizontal frame member;

wherein each of said restrictor posts are selectively adjustable relative to said upper frame horizontal member.

4. The training aid of claim 2, wherein said back cushion further comprises:

a covered foam-padded body extending outwardly from said upper horizontal frame member.

5. The training aid of claim 2, wherein said pair of hip posts each further comprises:

a hollow hip post sleeve; and, an integral hip post member protruding perpendicularly outward from said hip post sleeve;

wherein said hip post sleeve provides a lateral sliding engagement and securement to said upper horizontal frame member;

wherein said hip post member extends outwardly parallel to a ground surface when each of said pair of hip posts are secured to said upper horizontal frame member; and wherein each of said pair of hip posts are maintained on said upper horizontal frame member when not secured thereto.

6. The training aid of claim 5, wherein each of said upper pair of hip posts is selectively adjustable to a desired position by mating a desired one of a plurality of upper frame horizontal post apertures on said upper frame horizontal post with a hip post aperture on each of said hip post sleeves and inserting a locking pin therethrough.

7. A golf training aid, comprising:

a frame portion, comprising a lower frame member removably inserted into an upper frame member, said lower frame member having spaced apart apertures, a first foot at one end and a second foot at another end;

a back cushion selectively and removably positioned on said upper frame member;

a pair of hip posts each selectively positioned on said upper frame member;

a ball positioning assembly on said lower frame member, said ball positioning assembly having a ball alignment sleeve with a ball alignment aperture slideably located on said lower frame member, a ball positioning pointer and a ball alignment pin; and, a pair of vertical restrictor posts each selectively positioned on said upper frame member;

wherein said upper frame member is adjustable relative to said lower frame member; and wherein said ball positioning assembly can be locked in place on said lower frame member by said ball alignment pin passing through said ball alignment aperture and an aperture in said lower frame member.

8. The training aid of claim 7, wherein said upper frame comprises a "U"-shaped frame body comprising:

an upper horizontal frame member; and, a pair of upper frame posts parallel to each other and depending downward from said upper horizontal frame member;

said lower frame member further comprises:

a pair of lower frame posts extending up from said first foot and from said second foot;

wherein each of said lower frame posts are removably inserted into each of said upper frame posts; and, wherein said upper frame member is selectively adjustable to a desired position by mating a desired one of a plurality of upper frame post apertures on each of said pair of upper frame posts with a lower frame post aperture on each of said lower frame posts and inserting a locking pin therethrough.

9. The training aid of claim 8, further comprising a pair of horizontal restrictor posts each removably inserted into a restrictor post aperture on opposing ends of said upper horizontal frame member;

wherein each of said horizontal restrictor posts are selectively adjustable relative to said upper frame horizontal member.

10. The training aid of claim 8, wherein said back cushion further comprises:

a covered foam-padded body extending outwardly from said upper horizontal frame member.

11. The training aid of claim 8, wherein said pair of hip posts each further comprises:

a hollow hip post sleeve; and, an integral hip post member protruding perpendicularly outward from said hip post sleeve;

wherein said hip post sleeve provides a lateral sliding engagement and securement to said upper horizontal frame member;

wherein said hip post member extends outwardly parallel to a ground surface when each of said pair of hip posts are secured to said upper horizontal frame member; and wherein each of said pair of hip posts are maintained on said upper horizontal frame member when not secured thereto.

12. The training aid of claim 11, wherein each of said pair of hip posts is selectively adjustable to a desired position by mating a desired one of a plurality of upper frame horizontal post apertures on said upper frame horizontal post with a hip post aperture on each of said hip post sleeves and inserting a locking pin therethrough.

13. The training aid of claim 8, wherein said pair of vertical restrictor posts each further comprises:

a vertical restrictor sleeve; and, an integral vertical restrictor member protruding perpendicularly outward from said vertical restrictor sleeve;

wherein said vertical restrictor sleeve provides a vertical sliding engagement and securement to one of said pair of upper frame posts;

wherein said vertical restrictor member extends outwardly parallel to a ground surface when each of said pair of vertical restrictor posts are secured to one of said pair of upper frame posts; and wherein each of said pair of vertical restrictor posts are maintained on one of said pair of upper frame posts when not secured thereto.

14. The training aid of claim 13, wherein each of said pair of vertical restrictor posts is selectively adjustable to a desired position by mating a desired one of said plurality of upper frame post apertures on each of said pair of upper frame posts with a vertical restrictor aperture on each of said vertical restrictor sleeves and inserting a locking pin therethrough.

* * * * *